US007965239B2

(12) United States Patent
Yang et al.

(10) Patent No.: US 7,965,239 B2
(45) Date of Patent: Jun. 21, 2011

(54) ANTENNA STRUCTURE

(75) Inventors: Chung-Wen Yang, Taipei (TW); Yu-Yuan Wu, Taipei (TW); Hung-Jen Chen, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 222 days.

(21) Appl. No.: 12/491,242

(22) Filed: Jun. 25, 2009

(65) Prior Publication Data

US 2010/0328159 A1 Dec. 30, 2010

(51) Int. Cl.
*H01Q 1/38* (2006.01)
*H01Q 5/00* (2006.01)
*H01Q 9/04* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 6,707,428 | B2 * | 3/2004 | Gram | 343/700 MS |
| 6,856,285 | B2 * | 2/2005 | Bettin et al. | 343/700 MS |
| 6,995,717 | B2 * | 2/2006 | Ryu | 343/702 |
| 7,183,982 | B2 * | 2/2007 | Kadambi et al. | 343/702 |
| 7,576,698 | B2 * | 8/2009 | Cheng | 343/700 MS |
| 7,609,213 | B2 * | 10/2009 | Wong et al. | 343/702 |
| D603,850 | S * | 11/2009 | Wu et al. | D14/230 |
| 7,629,932 | B2 * | 12/2009 | Wang et al. | 343/702 |
| 7,728,776 | B2 * | 6/2010 | Lin et al. | 343/702 |
| D633,483 | S * | 3/2011 | Su et al. | D14/230 |
| 2004/0104851 | A1 * | 6/2004 | Kadambi et al. | 343/700 MS |
| 2006/0033668 | A1 * | 2/2006 | Ryu | 343/702 |
| 2006/0055602 | A1 * | 3/2006 | Huber et al. | 343/700 MS |
| 2009/0091508 | A1 * | 4/2009 | Fabrega-Sanchez et al. | 343/872 |
| 2009/0146906 | A1 * | 6/2009 | Anguera Pros et al. | 343/906 |
| 2009/0231214 | A1 * | 9/2009 | Mukouyama | 343/702 |
| 2010/0033381 | A1 * | 2/2010 | Liu et al. | 343/700 MS |
| 2011/0043408 | A1 * | 2/2011 | Shi et al. | 343/700 MS |

* cited by examiner

*Primary Examiner* — Douglas W Owens
*Assistant Examiner* — Jennifer Hu

(57) ABSTRACT

An antenna structure includes a low frequency radiator, a high frequency radiator, and a connecting element. The connecting element has a rear end and a front end opposite to the rear end. A feeding element and a grounding element are extended from the front end of the connecting element and arranged adjacent to each other. The low frequency radiator includes a substantially inverted-L shaped first radiating part extended from the rear end of the connecting element, a meander-like second radiating part extended frontward from a front end of the first radiating part, and a substantially lying U-shaped third radiating part with a rearward opening extended from a free end of the second radiating part. The high frequency radiator includes a first extension piece extended frontward from the front end of the connecting element and located under the second radiating part with space.

5 Claims, 2 Drawing Sheets

ANTENNA STRUCTURE

BACKGROUND OF THE INVENTION

1. Field of the Invention

The present invention relates to an antenna structure, and more particularly to an antenna structure used in a communication device.

2. The Related Art

Antennas are widely used in various communication devices, such as mobile phones and notebook computers. Taking the mobile phones as an example, with the wireless communication technology, outboard antennas have been superseded gradually by built-in antennas. Furthermore, accompanying with the trend of miniaturization for the communication devices, the mobile phones are designed to be more and more light and portable for consumers to use, then the internal space of the mobile phones is limited. So the dimension of the built-in antennas should be correspondingly reduced to be small enough for being assembled in the limited space of mobile phones.

Among the present wireless technologies, wireless communication frequency bands for mobile phones include global system for mobile communications (GSM) band about 850 MHz, extended global system for mobile communications (EGSM) band about 900 MHz, digital cellular system (DCS) band about 1800 MHz and personal communication services (PCS) band about 1900 MHz. However, if the conventional antennas used in mobile phone support two or more frequency bands, it may increase dimension, which is undesirable in the circumstance where the sizes of the mobile phones are limited.

SUMMARY OF THE INVENTION

It is an object of the present invention to provide an antenna structure which has reduced dimension can be assembled in the limited space of the mobile phone. The antenna structure includes a low frequency radiator, a high frequency radiator, a connecting element, a feeding element and a grounding element. The connecting element has a rear end and a front end opposite to the rear end. The low frequency radiator includes a first radiating part extended upward from the rear end of the connecting element and then bent frontward to show a substantially inverted-L shape, a second radiating part extended frontward from a front end of the first radiating part to show a substantial meander, and a third radiating part extended from a free end of the second radiating part to show a substantially lying U-shape with a rearward opening. The third radiating part includes an upper branch connected to the second radiating part and a lower branch located under the upper branch. The high frequency radiator includes a first extension piece extended frontward from the front end of the connecting element and located under the second radiating part with a space. A front edge of the first extension piece is spaced away from a rear edge of the lower branch of the third radiating part.

As described above, the arrangement of the low frequency radiator and the high frequency radiator makes the antenna structure capable of transmitting/receiving frequency bands covering 900 MHz, 1800 MHz and 1900 MHz. The second radiating part of the low frequency radiator bent as a meander line helps to shorten the whole length of the antenna structure.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
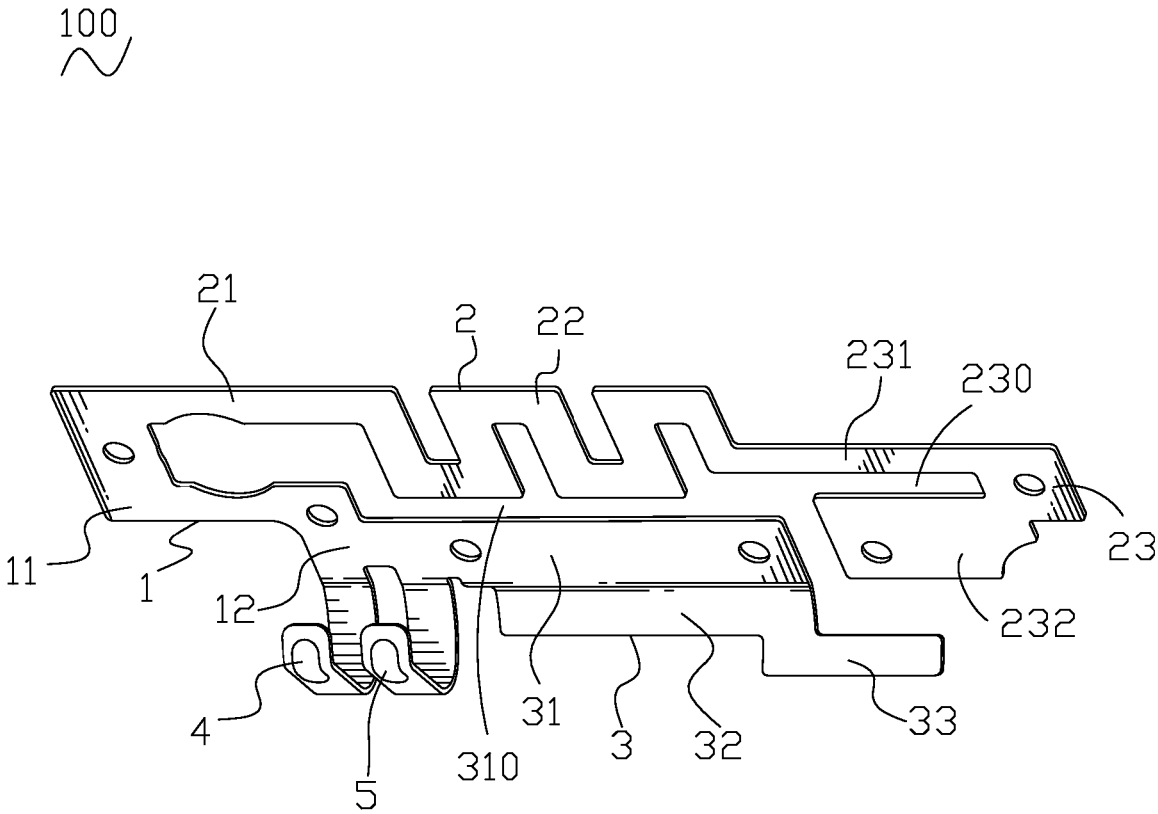
FIG. 1 is a perspective view of an antenna structure in accordance with the present invention.

An antenna structure 100 according to a preferred embodiment of the present invention is illustrated in FIG. 1. The antenna structure 100 which may be formed by pattern etching a copper-plated sheet of synthetic material includes a low frequency radiator 2, a high frequency radiator 3 and a connecting element 1 connecting the low frequency radiator 2 with the high frequency radiator 3.

The connecting element 1 formed as a substantial zigzag structure has a rear end 11 where the low frequency radiator 2 is extended and a front end 12 opposite to the rear end 11 where the high frequency radiator 3 is extended. The antenna structure 100 further includes a feeding element 4 and a grounding element 5 extended from the front end 12 of the connecting element 1. The feeding element 4 and the grounding element 5 are adjacent to each other. And moreover, the grounding element 5 is arranged closer to the high frequency radiator 3 than the feeding element 4.

The low frequency radiator 2 includes a first radiating part 21, a second radiating part 22 and a third radiating part 23. The first radiating part 21 is extended upward from the rear end 11 of the connecting element 1 and bent frontward to show a substantially inverted-L shape. The second radiating part 22 is extended frontward from a front end of the first radiating part 21 to show a substantial meander line with a first downward extension and a final downward extension close to the high frequency radiator 3. The third radiating part 23 is extended from a free end of the second radiating part 22 to show a substantially lying U-shape with a rearward opening 230. The third radiating part 23 includes an upper branch 231 connected to the second radiating part 22 and a lower branch 232 located under the upper branch 231.

The high frequency radiator 3 includes a first extension piece 31, a second extension piece 32 and a third extension piece 33. The first extension piece 31 is extended frontward from the front end 12 of the connecting element 1 and located under the second radiating part 22 with a space 310. A front edge of the first extension piece 31 is spaced away from a rear edge of the lower branch 232 of the third radiating part 23. The second extension piece 32 is extended and bent from a lower edge of the first extension piece 31 to form an obtuse angle between the first extension piece 31 and the second extension piece 32. The third extension piece 33 is located below the second extension piece 32 and connected with a front end of the second extension piece 32 by a rear end thereof. The third extension piece 33 is spaced away from the lower branch 232 of the third radiating part 23. Because the front edge of the first extension piece 31 is spaced away from the rear edge of the lower branch 232 and the third extension piece 33 is spaced away from the lower branch 232, the high frequency radiator 3 and the second radiating part 23 of the low frequency radiator 2 can generate a coupling effect therebetween. The coupling helps to increase the antenna gain and improve the antenna efficiency.

Once an electric current is fed into the antenna structure 100 via the feeding element 4, the antenna structure 100 can resonate different electromagnetic waves. When the electric current is through the low frequency radiator 2, the low frequency radiator 2 produces a resonance mode corresponding EGSM to transmit/receive a lower frequency band about 900 MHz. While the electric current is through the high frequency radiator 3, the high frequency radiator 3 produces a resonance mode corresponding DCS and PCS to transmit/receive a higher frequency band about 1800 MHz and 1900 MHz.

Figure 2:
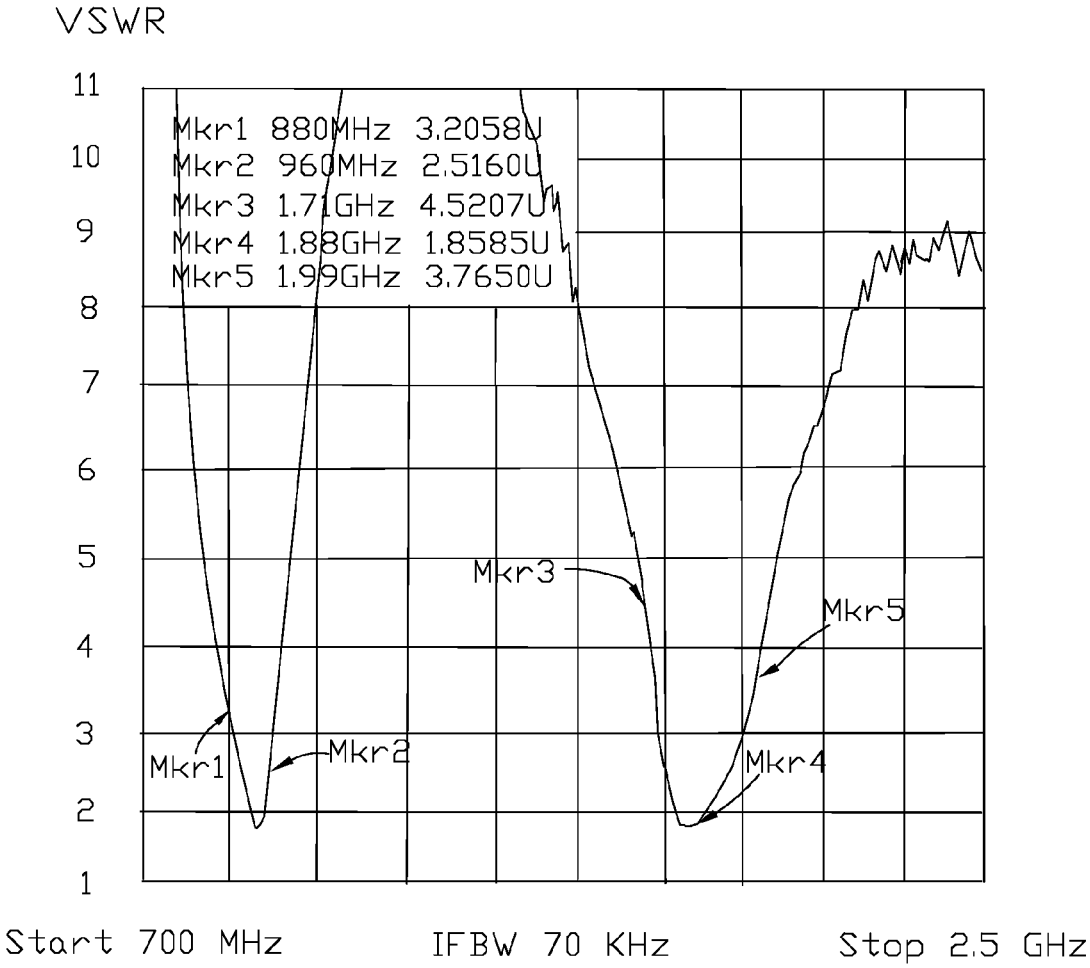
FIG. 2 is a test chart recording of Voltage Standing Wave Ratio (VSWR) of the antenna structure as a function of frequency.

In order to illustrate the effectiveness of the present invention, FIG. 2 sets a test chart recording of Voltage Standing Wave Ratio (VSWR) of the antenna structure 100 as a function of frequency. The antenna structure 100 respectively works in 880 MHz (Mkr 1), 960 MHz (Mkr 2), 1.71 GHz (Mkr 3), 1.88 GHz (Mkr 4), and 1.99 GHz (Mkr 5), and the values of the VSWR are 3.2058, 2.5160, 4.5207, 1.8585 and 3.7650, respectively. Note that the VSWR drops below the desirable value "2" shows the antenna structure 100 obtains great antenna gain and high antenna efficiency when operates at frequency bands about 900 MHz, 1800 MHz and 1900 MHz.

As described above, the arrangement of the low frequency radiator 2 and the high frequency radiator 3 makes the antenna structure 100 capable of transmitting/receiving frequency bands covering 900 MHz, 1800 MHz and 1900 MHz. The second radiating part 22 of the low frequency radiator 2 bent as a meander line helps to shorten the whole length of the antenna structure 100. The coupling between of the high frequency radiator 3 and the second radiating part 23 of the low frequency radiator 2 can increase the antenna gain and improve the antenna efficiency.

What is claimed is:

1. An antenna structure, comprising:

a connecting element having a rear end and a front end opposite to the rear end;

a low frequency radiator, including a first radiating part extended upward from the rear end of the connecting element and then bent frontward to show a substantially inverted-L shape, a second radiating part extended frontward from a front end of the first radiating part to show a substantial meander line, and a third radiating part extended from a free end of the second radiating part to show a substantially lying U-shape with a rearward opening, the third radiating part including an upper branch connected to the second radiating part and lower branch located under the upper branch;

a high frequency radiator, the high frequency radiator including a first extension piece extended frontward from the front end of the connecting element and located under the second radiating part with a space, a front edge of the first extension piece being spaced away from a rear edge of the lower branch of the third radiating part;

a feeding element extended from the connecting element; and a grounding element extended from the connecting element and adjacent to the feeding element.

2. The antenna structure as claimed in claim 1, wherein the high frequency radiator further includes a second extension piece extended and bent from a lower edge of the first extension piece, an obtuse angle formed between the first extension piece and the second extension piece.

3. The antenna structure as claimed in claim 2, wherein the high frequency radiator further includes a third extension piece located below the second extension piece and connected with a front end of the second extension piece by a rear end thereof, the third extension piece is spaced away from the lower branch of the third radiating part.

4. The antenna structure as claimed in claim 1, wherein the grounding element and the feeding element are extended from the front end of the connecting element, the grounding element is arranged closer to the high frequency radiator than the feeding element.

5. The antenna structure as claimed in claim 1, wherein the meander-like second radiating part is extended from the first radiating part with a first downward extension and a final downward extension close to the high radiating radiator.

* * * * *